US006432272B1

(12) United States Patent
Hollenberg et al.

(10) Patent No.: US 6,432,272 B1
(45) **Date of Patent: *Aug. 13, 2002**

(54) COMPRESSED ABSORBENT FIBROUS STRUCTURES

(75) Inventors: David H. Hollenberg, Kaukauna, WI (US); Jay C. Hsu; Joseph Mitchell, both of Alpharetta, GA (US); Sheng H. Hu, Appleton, WI (US); Richard I. Wolkowicz, Cummings, GA (US); Wesley J. McConnell, Alpharetta, GA (US); Anand Kuchibhotla, Roswell, GA (US)

(73) Assignee: Kimberly-Clark Worldwide, Inc., Neenah, WI (US)

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 0 days.

(21) Appl. No.: 09/213,569

(22) Filed: Dec. 17, 1998

(51) Int. Cl.[7] ..... D21F 11/00

(52) U.S. Cl. ..... 162/204; 162/206; 162/164.1; 162/164.3; 162/168.3; 162/158

(58) Field of Search ..... 162/109, 113, 162/91–99, 947, 164.1, 164.3, 164.6, 168.2, 179, 205, 204, 206, 158, 116, 117

(56) References Cited

U.S. PATENT DOCUMENTS

| | | | | | |
|---|---|---|---|---|---|
| 1,989,048 | A | | 1/1935 | Winter et al. | |
| 3,798,120 | A | * | 3/1974 | Enloe et al. | 162/112 |
| 3,825,381 | A | | 7/1974 | Dunning et al. | |
| 3,908,659 | A | | 9/1975 | Wehrmeyer et al. | |
| 3,949,035 | A | | 4/1976 | Dunning et al. | |
| 3,953,638 | A | | 4/1976 | Kemp | |
| 4,036,679 | A | | 7/1977 | Back et al. | |
| 4,103,062 | A | | 7/1978 | Aberson | |
| 4,114,528 | A | | 9/1978 | Walker | |
| 4,191,609 | A | | 3/1980 | Trokhan | |
| 4,239,065 | A | | 12/1980 | Trokhan | |
| 4,241,007 | A | | 12/1980 | Tanaka et al. | |
| 4,473,440 | A | | 9/1984 | Ovans | |
| 4,637,859 | A | | 1/1987 | Trokhan | |
| 4,867,054 | A | | 9/1989 | Taylor | |
| 4,986,883 | A | | 1/1991 | Taipale et al. | |
| 5,048,589 | A | | 9/1991 | Cook et al. | |
| 5,106,655 | A | | 4/1992 | Boissevain et al. | |
| 5,114,539 | A | | 5/1992 | Penniman et al. | |
| 5,149,332 | A | | 9/1992 | Walton et al. | |
| 5,160,582 | A | | 11/1992 | Takahashi | |
| 5,163,365 | A | | 11/1992 | Taylor | |
| 5,195,300 | A | | 3/1993 | Kovacs | |
| 5,245,920 | A | | 9/1993 | Hess | |
| 5,252,275 | A | | 10/1993 | Sultze et al. | |
| 5,264,082 | A | * | 11/1993 | Phan et al. | 162/158 |
| 5,316,623 | A | * | 5/1994 | Espy | 162/164.3 |
| 5,324,575 | A | | 6/1994 | Sultze et al. | |
| 5,334,289 | A | | 8/1994 | Trokhan et al. | |
| 5,336,373 | A | | 8/1994 | Scattolino | |
| 5,357,854 | A | | 10/1994 | Dahlgren et al. | |
| 5,378,497 | A | | 1/1995 | Johnson et al. | |
| 5,384,011 | A | | 1/1995 | Hazard, Jr. | |
| 5,384,012 | A | | 1/1995 | Hazard, Jr. | |
| 5,399,412 | A | | 3/1995 | Sudall et al. | |
| 5,409,572 | A | * | 4/1995 | Kershaw et al. | 162/109 |
| 5,437,766 | A | * | 8/1995 | Van Phan et al. | 162/127 |
| 5,505,820 | A | | 4/1996 | Donigian et al. | |
| 5,556,511 | A | | 9/1996 | Bluhm et al. | |
| 5,616,207 | A | | 4/1997 | Sudall et al. | |
| 5,656,134 | A | | 8/1997 | Marinack et al. | |
| 5,672,248 | A | * | 9/1997 | Wendt et al. | 162/109 |
| 5,681,300 | A | | 10/1997 | Ahe et al. | |
| 5,685,954 | A | | 11/1997 | Marinak et al. | |
| 5,690,788 | A | | 11/1997 | Marinack et al. | |
| 5,693,403 | A | | 12/1997 | Brown et al. | |
| 5,725,734 | A | | 3/1998 | Herman et al. | |
| 5,743,177 | A | | 4/1998 | Wostbrock | |
| 5,746,887 | A | | 5/1998 | Wendt et al. | |
| 5,779,860 | A | | 7/1998 | Hollenberg et al. | |
| 5,806,432 | A | | 9/1998 | Kurth | |
| 5,820,731 | A | | 10/1998 | Söderholm | |
| 5,888,347 | A | * | 3/1999 | Engel et al. | 162/117 |
| 5,891,308 | A | | 4/1999 | Skauegen | |
| 5,893,965 | A | | 4/1999 | Trokhan et al. | |
| 5,904,812 | A | * | 5/1999 | Salman et al. | 162/117 |
| 5,932,068 | A | * | 8/1999 | Farrington, Jr. et al. | 162/117 |
| 5,944,273 | A | * | 8/1999 | Lin et al. | 242/160.4 |
| 5,980,691 | A | * | 11/1999 | Weisman et al. | 162/117 |
| 5,993,602 | A | * | 11/1999 | Smith et al. | 162/112 |
| 6,033,523 | A | * | 3/2000 | Dwiggins et al. | 162/111 |
| 6,077,393 | A | * | 6/2000 | Shannon et al. | 162/158 |
| 6,171,695 | B1 | | 1/2001 | Fontenot et al. | 428/337 |

FOREIGN PATENT DOCUMENTS

| | | |
|---|---|---|
| CA | 695194 | 9/1964 |
| DE | 0402513 A1 | 12/1990 |
| EP | 0077005 A1 | 4/1983 |
| EP | 0691274 A1 | 1/1996 |
| GB | 2293611 A | 4/1996 |
| GB | 2303647 A | 2/1997 |
| WO | WO9609435 | 3/1996 |
| WO | WO9733043 | 9/1997 |

OTHER PUBLICATIONS

U. S. Patent application entitled 'Wet Resilient Webs'; inventors: F. J. Chen, R. J. Kamps, M. A. Burazin, D. H. Hollenberg, M. A. Hermans, B. E. Kressner, and J. D. Lindsay; Ser. No. 08/912,906; field Aug. 15, 1997.

* cited by examiner

*Primary Examiner*—Jose Fortuna
(74) *Attorney, Agent, or Firm*—Dority & Manning, P.A.

(57) ABSTRACT

The present invention provides compressed paper webs that maintain a substantial amount of their absorptive capacity and wet strength when compressed. The compressed webs bounce back to a portion of their uncompressed state when wetted. The present compressed webs allow more towels to be added to a dispenser without substantially sacrificing the absorbent capacity or the strength of the towels.

12 Claims, No Drawings

COMPRESSED ABSORBENT FIBROUS STRUCTURES

FIELD OF THE INVENTION

The present invention generally relates to absorbent fibrous paper-based structures such as hand towels, tissues, wipers, and the like, and more specifically, to compressed absorbent fibrous structures.

BACKGROUND OF THE INVENTION

Absorbent fibrous structures, such as hand towels, wipers, tissues, and the like, as well as various components for other fluid-handling and absorbing materials are well known in the art. These structures may be formed from materials that allow them to be absorbent so that the structures will typically absorb, in varying degrees, liquids from one's body or elsewhere. Such liquids may include water, coffee, milk, cleaning formulations, oil, etc., and various bodily fluids such as blood, urine, nasal discharge and other body exudates. Various natural wood pulp fibers, as well as synthetic fibers, may be useful for making such fibrous structures.

Often, absorbent fibrous structures such as hand towels (commonly referred to as "paper towels") will be wound onto various types of paperboard cores. These paperboard cores, with towels wound onto them, may be placed in various types of dispensing mechanisms to allow users to dispense one or more towel at a time from the roll. The rolls of towels may be perforated at various points to divide bulk rolls into single sheet towels. During dispensing, a user may tear one or more towels along the perforation lines for use. When the towels are not perforated, teeth may be provided on the dispenser for assisting in tearing the roll into individual towels.

Due to the bulkiness of the paper rolls, only a defined number or length of towels, and thus a defined number of drying uses, may be available from each roll. This number of drying uses may be typically referred to as the number of hand dries available.

The size of the paper rolls, and thus the resulting number of hand dries, may be limited by the size of the dispensers in which the rolls may be kept. Most standard-sized roll towel dispensers may accept a paper towel roll of approximately 8 to 9 inches in diameter. Often, use of the paper towels from the roll must be monitored and the dispenser must be refilled frequently in order to prevent depletion of the product.

Some paper towels, on the other hand, may be provided in a folded condition with multiple towels stacked on top of one another. In such arrangements, a single towel may be dispensed one at a time. Often, like the roll towel dispensers, the dispensers in which folded towels are stacked and dispensed also may have a limited capacity and must, likewise, be monitored and refilled frequently.

Towel run-out occurs when the towels within a dispenser are exhausted and a janitor has not yet replenished the dispenser with a fresh or additional supply of new towels. Towel run-out may be one of the most common complaints from hand towel end users. Preventing towel run-out may require either more frequent visits by the janitor or the addition of more towels in the dispenser. The former solution is most likely not desired by towel end users or the entities that purchase the towels for end use because an increase in janitorial visits obviously increases labor costs. It seems that the latter solution has not heretofore been workable because of the fixed sizes of the dispensers and the thicknesses of the typical towels.

Even when rolls of towels are added on a frequent basis, the presently-employed roll towels may result in significant waste. Often, it will be necessary to replace a roll of towels prior to completely using the entire roll in order to prevent towel run-out. The amount of towels remaining on the roll may not justify continued utilization of the remainder of towels on the roll and, thus, the remainder of the yet-to-be-used towels are often discarded along with the core.

It has generally been perceived that the bulkier, or thicker, that a paper towel, tissue, or wiper is, then the more absorbent and "softer" it is. While such attributes are desirable and may be obtained by creating fibrous structures with greater thicknesses, the additional thickness creates numerous disadvantages. For example, as the thickness of a towel increases, the number or length of towels, and thus the number of drying uses, that can be placed inside a standard dispenser decreases.

Another consideration that is a disadvantage when using conventional-sized towels is that there is a defined number of hand dries per case of towel rolls or case of folded towel packages. It would be desirable from a shipping cost standpoint (both freight and shipping materials cost) and from a storage standpoint to fit more hand dries into each case of towels. In particular, the end user would need to store fewer cases of towels at its facilities if more hand dries could be found in a case.

Moreover, when using rolled towels, the inner core upon which the towels are wound must be disposed of. The more towels that can be placed on a roll, the less frequent is the disposal of such cores. If additional numbers of towels could be wound onto a roll, conservation and recycling efforts could be enhanced by allowing a core to be used for a longer period of time.

The present invention addresses some of the needs outlined above and provides an improvement to towel run-out and excessive waste by providing more towels within a standard-sized towel dispenser.

U.S. Pat. No. 5,779,860 to Hollenberg et al., which is commonly owned by the assignee of the present invention is directed to a product and process that utilizes compression techniques to increase the density of and decrease the caliper of various webs so that space-saving towels of the type discussed herein may be obtained. However, the absorbent structures discussed therein are compressed into structures that will have a thickness of less than about 50% of the thickness of the original uncompressed structure. In other words, the uncompressed webs of Hollenberg et al. are compressed so as to increase their densities at least about 50%. For example, an uncompressed web having a density of about 0.2 grams per cubic centimeter may be compressed so that its density is increased to about 0.3 grams per cubic centimeter or greater. In particular, the webs containing high yield pulps, such as bleached chemithermomechanical pulp, may be compressed at such ranges and still maintain their structure and wet strength. In fact, when saturated with water, the density of such compressed webs will decrease about 20 percent or greater. As discussed herein the present inventive webs provide certain of the advantages of the webs described in Hollenberg et al., but are formed from different materials and with different processes.

SUMMARY OF THE INVENTION

In accordance with the present invention, certain advantages are accomplished by compressing a paper web that has a temporary or permanent wet strength. The resulting paper web may allow more feet of towels to be added to a towel roll (or more towels to be added to a stack of folded towels) without substantially increasing the diameter of the roll (or the thickness of the stack of towels). More sheets on a roll (or more towels in a folded towel stack) may mean fewer roll (or folded towel) changes and replenishings for the end user. Fewer rolls per case and a reduced case size may translate into fewer cores and shipping cases to be disposed of. The invention may also allow more towels to be shipped on the same truck or placed into a standard shipping storage compartment.

A compression force may be applied to the paper web to provide a compressed paper web having a certain reduced caliper. The amount of compression applied to the paper web may be expressed as a "caliper compression ratio" as defined herein.

Desirably, the caliper compression ratio will be between about 0.1 and about 0.5 in order to meet the requirements of the present invention.

In addition, the compressed webs of the present invention will have a water absorbent capacity of at least about 70% of the water absorbent capacity of the same web prior to compression, desirably at least about 80%, and even more desirably at least about 90%.

The presently inventive compressed webs have also been found to "spring back", or expand, to a certain extent upon wetting. Such expansion may allow the webs to recover as much as from about 60% to about 150% of their original dry uncompressed caliper when wet after being compressed.

The sponge-like action of these compressed webs allows them to maintain absorbency characteristics similar to those of the original, uncompressed web. However, because the webs are compressed, more towels may be placed inside a single dispenser, whether the dispenser is for holding folded towels or for holding towels on a roll core. In any event, the frequency of monitoring the towel supply may be reduced by employing the presently compressed webs. In addition, the frequency of excessive waste discards may also be reduced by employing the present invention.

The compression required by the present invention can be imparted by several different processes. For example, an extra calendering step may be utilized or, in one alternative, increased pressure may be imparted to the original calendering rolls utilized in a process for making the fibrous absorbent structure.

Various fibers may be employed in forming the webs of the present invention. For example, wood pulp fibers, in 100% amounts, may be utilized. Alternatively, mixtures of wood pulp fibers with other types of fibers, including various synthetic fibers such as meltblown and spunbonded fibers may be used. In addition, other types of fibers and filaments may be used to provide a desired resiliency to the webs. For example, fibers produced from chemical thermal mechanical pulping processes and thermal mechanical pulping processes, or other high yield pulping processes, as well as curled fibers that are produced by various methods such as by high-consistency refining, and fibers that are internally cross-linked may be employed.

While various types of webs may be utilized in forming the compressed absorbent fibrous structures of the present invention, webs produced according to the uncreped through-air dried, heavy wet creped, and light dry creped processes described herein provide favorable compressed towel products that exhibit acceptable consumer-desired characteristics such as absorbency and feel.

These and other features, aspects and advantages of the present invention will become better understood with reference to the following description and appended claims.

DETAILED DESCRIPTION OF THE PREFERRED EMBODIMENTS

Reference now will be made in detail to the embodiments of the invention, one or more examples of which are set forth below.

Each example is provided by way of explanation of the invention, not limitation of the invention. In fact, it will be apparent to those skilled in the art that various modifications and variations can be made in the present invention without departing from the scope or spirit of the invention. For instance, features illustrated or described as part of one embodiment, can be used on another embodiment to yield a still further embodiment. Thus, it is intended that the present invention cover such modifications and variations as come within the scope of the appended claims and their equivalents. Other objects, features and aspects of the present invention are disclosed in or are obvious from the following detailed description. It is to be understood by one of ordinary skill in the art that the present discussion is a description of exemplary embodiments only, and is not intended as limiting the broader aspects of the present invention.

In general, the present invention relates to compressed webs useful in forming absorbent fibrous structures such as paper towels and the like. In addition, the present compressed webs could be used for other absorbent applications such as components of diapers, bed pads, feminine hygiene products, incontinence products, and the like. When the present compressed webs are utilized in the above-mentioned and other absorbent products, thinner, less bulky products are available to the consumer. Such thinner, less bulky absorbent products allow for certain advantages in storage space, in dispensing space, and, when the absorbent product is worn by a consumer, in comfort for the wearer.

Despite being compressed, and contrary to conventional wisdom, the towels and other absorbent structures formed according to the present invention do not substantially lose the necessary absorbent capacity to function as absorbent structures. In addition, the absorbent structures maintain desirable characteristics such as feel and other qualitative aspects.

The webs may be made from various fibers, including various cellulosic fibers such as natural wood pulps in conjunction with various additive fibers, including fibers made from synthetic resins. The fibers useful for making the sheets of the present invention may be wet resilient fibers that include various high yield pulp fibers, flax, milkweed, abaca, hemp, cotton or any of the like that are naturally wet resilient or any wood pulp fibers that are chemically or physically modified. Such pulp fibers may include fibers that are crosslinked or curled so that they have the capacity to recover after deformation in the wet state, as opposed to non-resilient fibers that may remain deformed and do not recover after deformation in the wet state.

Desirably, the absorbent structure must be sufficiently dimensionally stable so that the web will avoid collapsing when the web is contacted with water. Without such resiliency, the compressed web would be relatively useless for the various absorbent end uses contemplated by the present invention.

As known in the art, various materials may be utilized to add additional wet strength to the resulting compressed absorbent structures. Such wet strength agents are commercially available from a wide variety of sources and some of such agents are generally described in U.S. Pat. No. 5,779,860 to Hollenberg et al., which is incorporated herein in its entirety by reference thereto. Any material that, when added to a paper or tissue, results in providing a wet strength to dry strength ratio in excess of 0.1 will be considered a suitable wet strength agent. Such agents are generally classified as "permanent" or "temporary" wet strength agents. Permanent agents provide a product that retains more than 50% of its original wet strength after exposure to water for a period of at least five minutes; temporary agents provide a product that retains less than 50% of its original wet strength after exposure to water for five minutes. Such agents, whether permanent or temporary, are typically added to pulp fibers in an amount of at least about 0.1 dry weight percent, and usually in an amount of from about 0.1 to about 3 dry weight percent, based on the dry weight of the pulp fibers.

Desirably, the absorbent webs of the present invention will be made according to the uncreped through air-dried, heavy wet creped or light dry creped. The webs of the present invention, after being formed, are then compressed by exerting on them a certain force per linear inch while passing through one or more calendering or supercalendering roll arrangements. Mechanisms other than calendering processes may also be employed to supply the necessary compressive forces.

As used herein, the term "calender" refers to a process for fabrics or nonwoven webs that reduces the caliper and imparts surface effects, such as increased gloss and smoothness. Generally, the process includes passing the fabric through two or more heavy rollers, sometimes heated, and under high nip pressures.

Processes for forming uncreped through-air dried webs are described in U.S. Pat. No. 5,779,860 to Hollenberg et al. and U.S. Pat. No. 5,048,589 to Cook et al., both of which are assigned to the assignee of the present invention and both of which are incorporated herein in their entireties by reference thereto. In such processes, through air drying is employed as shown in the Figures of Cook et al. As described and shown therein, a web is prepared by: (1) forming a furnish of cellulosic fibers, water, and a chemical debonder; (2) depositing the furnish on a traveling foraminous belt, thereby forming a fibrous web on top of the traveling foraminous belt; (3) subjecting the fibrous web to noncompressive drying to remove the water from the fibrous web; and (4) removing the dried fibrous web from the traveling foraminous belt. The process described therein does not include creping and is, thus, referred to as an uncreped through-air drying process.

Towels prepared from this uncreped through-air drying process will typically possess relatively high levels of absorbent capacity, absorbent rate, and strength. In addition, because the process avoids the use of costly creping steps, towels produced according to such a process will generally be more economical to produce than creped towels of similar composition and basis weight.

A process that produces a noncompressed sheet using can drying which may be employed in the present invention is described in U.S. Pat. No. 5,336,373 to Scattolino et al., which is incorporated herein in its entirety by reference thereto.

The caliper of the webs prior to compression according to the present process will typically be in the range of from about 0.005 (0.127 mm) to about 0.030 (0.762 mm) inches. After compression, a compressed web of the present invention will typically have a caliper of from about 50% to about 90% of its original caliper.

As used herein "caliper" refers to the thickness of a sheet or web. Caliper has been measured in the following examples utilizing an EMVECO Model 200-A with the following specifications: pressure foot lowering speed of 0.8 millimeter/second; surfaces of pressure foot and anvil parallel to within 0.001 millimeter; capability of repeated readings within 0.001 millimeter at zero setting or on the calibrated gage; a flat ground circular fixed face (anvil) of a size that is in contact with the whole area of the pressure foot in the zero position; capacity of 0–12.7 millimeter; sensitivity of 0.025 millimeter; load of 2.0 kiloPascals; anvil area of 2500 square millimeters; and an anvil diameter of 56.4 millimeters.

The compressed webs may be characterized as having a certain caliper compression ratio. The "caliper compression ratio" as used herein is defined by the following equation:

$$\frac{(\text{caliper of uncompressed web} - \text{caliper of compressed web})}{\text{caliper of uncompressed web}}$$

In the present webs, the caliper compression ratio would be between about 0.1 and about 0.5.

In addition, the compressed web may have an absorbent capacity sufficient to allow it to absorb liquids and function similarly to the same web in an uncompressed state. The absorbent capacity refers to the amount of liquid that can be absorbed by the paper web. Absorbent capacities discussed herein are defined according to the grams of water (or oil) absorbed by the absorbent structure divided by the weight in grams of the structure absorbing the water (or oil). The absorbent capacity of a sheet for oil indicates the internal void volume of the sheet. As the sheet is compressed, the internal void volume decreases.

The absorption capacity of paper products (either their water or oil absorbent capacities) may be determined according to the following procedure. A pan large enough to hold water to a depth of at least 2 inches (5.08 cm) is filled with distilled water (or oil). A balance, such as the OHAUS GT480 balance described herein, is utilized in addition to a stopwatch. A cutting device, such as that sold under the trade designation TMI DGD by Testing Machines, Inc., of Amityville, N.Y., and a die with dimensions of 4 inches by 4 inches (±0.01 inches) (10.16 cm by 10.16 cm±0.25 cm) are also utilized. Specimens of the die size are cut and weighed dry to the nearest 0.01 gram. The stopwatch is started when the specimen is placed in the pan of water (or oil) and soaked for 3 minutes ±5 seconds. At the end of the specified time, the specimen is removed by forceps and attached to a hanging clamp to hang in a "diamond" shaped position to ensure the proper flow of fluid from the specimen. In addition, the specimen is hung in a chamber having 100 percent relative humidity for 3 minutes ±5 seconds. The specimen is then allowed to fall into the weighing dish upon releasing the clamp. The weight is then recorded to the nearest 0.01 gram.

The absorbent or absorptive capacity of each specimen is then calculated as follows:

$$\text{Absorbent Capacity (g)} = \text{Wet weight (g)} - \text{Dry weight (g)}$$

Obviously, the particular absorbent capacity of a web depends on a variety of factors including its basis weight and its composition. Thus, webs having a variety of absorbent capacities may be utilized in the present invention and often depend largely on the needed capacity for the intended end use of the absorbent structures.

The present compressed webs will typically have a water absorptive capacity which is at least about 70% of the water absorptive capacity of an uncompressed paper web formed from the same materials by the same process and having an identical basis weight.

As used herein, "basis weight" refers to the mass per unit area of a web and is reported as grams per square meters or "gsm". Basis weight is measured by cutting a sample portion of a web and then subjecting that sample portion to the following procedure. A balance with a capacity and sensitivity to weigh to about 0.001 gram for specimens weighing under about 10 grams and to about 0.01 grams for specimens weighing about 10 grams and more is utilized. An exemplary balance that may be employed is sold under the trade designation OHAUS GT210 by VWR Scientific Product of South Plainfield, N.J. The standard weights for a balance range from about 10 milligram to about 100 grams. If a level is not supplied with the balance, then a sealed glass vial may be utilized. The weighing pan should be of a size large enough to hold the specimen without it hanging over the pan. Desirably, the minimum die size for a single specimen will be 4.5±0.1 inches (114±3 mm) by 4.5±0.1 inches (114±3 mm). If multiple smaller specimens are utilized, then any known size die would be appropriate. The ruler will be graduated in 0.1 inches or 1 mm increments.

Test specimens obtained from the webs would be free of folds, wrinkles, or any distortions. Desirably, all specimens would have a minimum area of at least 20 square inches (130 square centimeters) or a number of smaller die-cut specimens would be taken from different locations in the sample with a minimum total area of at least square inches (130 square centimeters). Each specimen would then be weighed and recorded.

Basis weights are then calculated by determining the area of the sample(s) in square inches. Then, the weight of the specimen(s) measured in grams is divided by the area. This value is then multiplied by a factor to obtain the desired units. The conversion factors for multiplying by (weight/area) are as follows:

| | | |
|---|---|---|
| $g/m^2$ | = | 1550 |
| $g/yd^2$ | = | 1296 |
| lb/2880 $ft^2$ (lb/ream) | = | 914.31 |
| $oz/yd^2$ | = | 45.72 |

Prior to testing any of the presently inventive webs, the sheets were conditioned at ASTM conditions of 50% relative humidity ±2% and at 72° F.±2° (22.2° C.±1.1°) for at least 24 hours.

Another characteristic of the present inventive webs is their ability to recover a major proportion of their original thickness, or bulkiness, that existed prior to compression. In other words, the webs are capable of expanding upon being exposed to water and will return to at least about 60% of their original uncompressed wet caliper, and desirably to at least about 80% of their original uncompressed wet caliper. Wet caliper refers to the caliper of a particular web after it is immersed in water for 30 seconds and then allowed to hang for one minute to allow the excess water to be removed therefrom.

In one particular example, a 22 lbs/ream of 2880 square feet basis weight paper web made according to the uncreped through-air drying process described above and made from a pulp furnish of 70% recycled fiber and 30% Mobile pine pulp obtained from the Kimberly-Clark pulp mill in Mobile, Ala., may be utilized. When the compressed web (having its caliper reduced 22% by compression) having this formulation was tested in a wet state against the same web in an uncompressed wet state, evaluators of the web's characteristics did not perceive a statistically significant difference in the overall quality, drying effectiveness, absorption rate or substantial feel between compressed and uncompressed towels.

In one study, towels in various compressive states were analyzed. For example, a roll that would normally be 800 feet in length in an uncompressed state was compressed so that the same diameter roll would result in a roll having 1000 feet in length (a 25% increase) and in a roll having 1200 feet in length (a 50% increase). The average length of uncompressed paper towels used per hand dry was 23.5" while the average length of compressed paper towels (at a compression of 25%) was 24.7" and the average length of compressed paper towels (at a compression of 50%) was 24.3".

Various processes may be employed to compress the presently inventive webs and the present invention is not limited to the use of any particular compression process. As is known in the art, passing sheets through one or more rollers or nips will compress and smoothen the surfaces of the sheet materials. The equipment employed to apply the compressive force are generally referred to as calenders or supercalenders. Obviously, the effect of calendering on a particular structure depends on the temperature, the pressure applied, and the duration of the pressure, with all three factors being variable to obtain the desired calendering results.

In compressing the webs of the present invention, an extra calendering step may be utilized or, in one alternative, increased pressure may be imparted to the original calendering rolls utilized in a process for making the fibrous absorbent structure. Various calendering techniques such as hot or steam calendering may be alternatively employed to produce the compressed absorbent webs.

Alternatively, the webs can be compressed using flat platten presses or fabric nips used to smooth and compact multiwiper products as disclosed in U.S. Pat. No. 5,399,412 to Sudall et al., which is incorporated herein in its entirety by reference thereto. In this manner, the resulting sheets of the present invention could have areas that are highly compressed and areas that are less compressed or not compressed at all.

Such compressing processes are generally described as imparting a certain force per linear inch on the paper web and are reported in pounds per linear inch ("PLI"). The "nip pressure" is another term used herein and refers to the pressure at the calendering nip. Nip pressure is defined by dividing the force per linear inch by the width of the nip formed between the calendering rollers.

The following examples are meant to be exemplary procedures only which aid in the understanding of the present invention. The invention is not meant to be limited thereto.

EXAMPLES 1–6

In Examples 1–3, a roll towel made by a through-air drying process was compared in an uncompressed state of 800' on a roll (Example 1); in a compressed state of 1000' on a roll (Example 2); and in a compressed state of 1200' on a roll (Example 3). Example 2 is the same roll of Example 1 that has been compressed to include 25% additional feet and Example 3 is that roll that has been compressed to include 50% additional feet.

The webs of Examples 1–3 made from a furnish containing 55% Owensboro recycled fibers, 28% Mobile pine, 7% Fox River recycled fibers and 10% broke. The webs have a basis weight of approximately 161 b/ream.

In Examples 4–6, rolls towels of identical diameters (7.9 inches or about 20 centimeters) made according to an uncreped through-air drying process was compared in an uncompressed state of 425' on a roll (Example 4); in a compressed state of 530' on a roll (Example 5); and in a compressed state of 640' on a roll (Example 6). Example 5 is the same roll of Example 4 that has been compressed to include 25% additional feet and Example 6 is that roll that has been compressed to include 50% additional feet.

Examples 4–6 are made from a furnish containing 20% Owensboro recycled fibers, 48% Mobile pine, 12% Fox River recycled fibers, and 11% broke. The webs have a basis weight of approximately 23 lb/ream 2880 square feet.

Tables 1–5 set forth various measurements that were made on the webs formed from Examples 1–6. Basis weight, Emveco caliper determinations, and oil/water absorbent capacities have been explained previously. A "wet" test refers to web samples that have been immersed in water for 30 seconds and then allowed to hang dry for 60 seconds thereafter prior to being analyzed.

"Machine direction" or "MD" refers to the direction of travel of the forming surface onto which fibers are deposited during formation of a material. "Cross-machine direction" or "CD" refers to the direction that is perpendicular and in the same plane as the machine direction.

"Drape" is a measure of the stiffness or resistance to bending of a fabric and is computed by determining the bending length of a fabric using the principle of cantilever bending of the fabric under its own weight. Except for the specimen size, the test to measure drape conforms to ASTM Standard Test D 1388. To determine drape, a FRL-Cantilever Bending Tester, Model 79-10 available from Testing Machines, Inc. of Amityville, N.Y. may be utilized. After conditioning as described herein, a 1"×8" specimen of fabric is cut and then slid on a horizontal surface at a rate of 4.75" per minute in a direction parallel to the specimen's long dimension and toward the edge of the horizontal surface on the tester. The specimen is moved until its leading edge projects from the edge of the horizontal surface. When the edge of the specimen reaches the knife edge, the switch of the tester is turned off and the overhang length is then recorded from the linear scale of the tester. This measurement is taken when the tip of the specimen is depressed under its own weight to the point where the line joining the tip to the edge of the horizontal surface makes a 41.5° angle with the horizontal surface. The longer the overhang, the slower the specimen was to bend. Thus, higher numbers indicate a stiffer fabric. Drape stiffness is expressed in centimeters and is computed by multiplying the bending length in inches by 2.54.

"Elmendorf Tear" is a measure of the force required to tear a sheet in a certain direction. It is calculated by dividing the tearing load by the web sample's basis weight. The tearing load measures the toughness of a material by measuring the work required to propagate a tear when part of a specimen is held in a clamp and an adjacent part is moved by the force of a pendulum freely falling in an arc. The Elmendorf Tear of the webs which determines the average force required to propagate a tear starting from a cut slit in the material is measured as follows (with higher numbers indicating the greater force required to tear the sample): The Elmendorf-type falling-pendulum instrument is equipped with a pendulum that has a deep cutout (recessed area) on the pendulum sector and pneumatically-activated clamps. Such testers may be sold under the trade designation LORENTZEN AND WETTRE BRAND, Model 09ED by Lorentzen Wettre Canada Inc. of Fairfield, N.J.

In addition to the testers, a specimen cutter is used that is capable of providing a 63.0±0.15 mm (2.5±0.006 inches) by 73±1 mm specimen being cut no closer than 15 mm from the edge of the material, without folds, creases or other distortions. The 63 mm length of the specimen is run vertically on the tear tester. The rotary dial of the tester is set to the number of specimen plies to be torn and then the cutting lever is activated. The specimen is placed between the clamps with the specimen edge aligned with the clamp front edge. The clamps are then closed and a slit is cut in the specimen by activating the cutting knife lever. The pendulum is then released and positioned to the starting position after traveling one full swing. The tear value is then recorded unless the tear line deviated more than 10 mm, in which case a new test would be conducted. The results are recorded in grams. The Tear CD is the tearing force required to tear in the direction perpendicular to the machine direction; the Tear MD is the tearing force required to tear in the direction perpendicular to the cross-machine direction.

Various strength tests were conducted as indicated in the following tables. Specifically, tensile strengths (peak loads), elongation (% stretch), TEA (tensile energy absorption) at fail and peak energies were determined for the various webs. The tensile strength is the maximum tensile stress developed in a test specimen before rupture on a tensile test carried to rupture under prescribed conditions and is the force per unit width of test specimen. Stretch or elongation is the maximum tensile strain developed in the test specimen before rupture in a tensile test carried to rupture under prescribed conditions and is expressed as a percentage (100 times the ratio of the increase in length of the test specimen to the original test length). Tensile energy absorption is the work done when a specimen is stressed to rupture in tension under prescribed conditions as measured by the integral of the tensile stress over the range of tensile strain from zero to maximum strain and is expressed as energy per unit area of the test specimen. The tests are identified in the tables and are shown as being determined for either the MD or the CD directions and for either the dry state or the wet state.

The following test method was used to perform the various strength tests on the paper sheets. The equipment included a tensile testing or constant-rate-of-extension (CRE) unit along with an appropriate load cell and computerized data acquisition system. An exemplary CRE unit is sold under the trade designation SINTECH 2 manufactured by Sintech Corporation, whose address is 1001 Sheldon Drive, Cary, N.C. 27513. The type of load cell was chosen for the tensile tester being used and for the type of material being tested. The selected load cell had values of interest falling between the manufacturer's recommended ranges of the load cell's full scale value. The load cell and the data acquisition system sold under the trade designation TestWorks™ may be obtained from Sintech Corporation as well.

Additional equipment included pneumatic-actuated jaws, weight hanging brackets, and a precision sample cutter. The jaws were designed for a maximum load of 5000 grams and may be obtained from Sintech Corporation. The weight hanging brackets included a flat bracket and an "L"-shaped bracket. These brackets were inserted into the jaws during calibration or set-up. A precision sample cutter was used to cut samples within 3±0.04 inch (76.2±1 mm) wide. An exemplary sample cutter is sold under the trade designation JDC by Thwing-Albert Instrument Co., of Philadelphia, Pa.

Tests were conducted in a standard laboratory atmosphere of 23±2° C. (73.4±3.6° F.) and 50±5% relative humidity. The two principal directions, machine direction (MD) and cross machine direction (CD) of the material was established. The specimens had a width of about 3 in. (7.62 cm) and a length of about 4 in. (10.2 cm). The length of the specimen was in the cross or machine direction of the material being tested depending on whether the machine or cross direction tensile was being measured for selecting length direction of specimens. Desirably, the length was cut approximately 1.5 inches longer than the jaw spacing used for the test and the test specimens were free of tears or other defects, and had clean cut, parallel edges.

The tensile tester was prepared as follows. A load cell was installed for the type for the tensile tester being used and for the type of material being tested. A load cell was selected so the values of interest fell between the manufacturers recommended ranges of the load cell's full scale value. The separation speed of the jaws was set at 10±0.4 inches/minute (25.4±1 cm/minute). The break sensitivity was set at a 65% drop from the peak. Furthermore, the slack compensation was set at 25 grams and the slope preset points were set at 70 and 157 grams. The threshold was set at 2% of the full scale load. Additionally, the jaws were installed on the tester and the tester calibrated by the manufacturer for the particular tensile tester/software being used.

The testing procedure began by inserting the specimen centered and straight into the jaws. Next, the jaws extending across the specimen's width were closed while simultaneously excessive slack was removed from the specimen. Afterward the machine was started and the jaws separated. The test ended when the specimen ruptured. That being done, the results were recorded.

"Mullen Burst" measures the toughness of a material by inflating the material with a diaphragm until it ruptures. These tests may be undertaken utilizing conventional testing equipment and techniques. These tests were conducted utilizing a Mullen Burst Strength Tester, such as those manufactured by B. F. Perkins & Son Inc., whose address is GPO 366, Chicopee, Mass. 01021 or Testing Machine Inc., whose address is 400 Bayview Avenue, Amityville, N.Y. 11701. The test procedure included clamping a sample having a length and width of about 12.7 centimeters above a rubber diaphragm, inflating the diaphragm by pressure generated by forcing liquid into a chamber at about 95 milliliters per minute, and recording the pressure at which the sample ruptures. The rupture pressure was reported in pascals.

The wet mullen burst procedure further includes saturating the sample with purified water and blotting the excess prior to clamping into the apparatus. Mullen burst is expressed in pounds per square inch.

The "Absorbency Rate" of water or oil is the time required, in seconds, for a specimen of tissue or paper to absorb a specified amount of test fluid. The absorbency of water or oil by a paper web is determined as follows. The absorbency rate is the average of four absorbency readings (two on the air side and two on the dryer side of the material). White mineral (paraffin) oil is typically used for the oil absorbency tests and deionized water is typically used for the water absorbency tests. Tests are conducted at a standard laboratory atmosphere of 23±1° C. (73.4±1.8° F.) and 50±2% relative humidity.

To determine the absorbency rate of water or oil, the chosen test fluid is poured into a small stainless-steel beaker. A Plexiglas® or stainless-steel template having approximate dimensions of 5 in. by 5 in. (12.7 cm by 12.7 cm) with a two-inch diameter opening is employed to hold the sample in place on the top of the beaker.

The specimens of fabric to be tested are then conditioned as described herein. After conditioning, the specimens are draped over the top of the stainless-steel beaker and covered with the template to hold the specimen in place. A pipette is filled with an amount of test fluid (water or oil) by depressing the button half way down to fill pipette, 1 click. The pipette tip is held one inch above the specimen and at a right angle to the specimen. Test fluid is then dispensed from the pipette onto the specimen, and the timer is started. After the fluid is completely absorbed onto the specimen, the time is stopped.

If the timer/stopwatch was not stopped between specimens then the total number of seconds is divided by four and the number is recorded in seconds. "Water wicking" refers to the rate at which the web absorbs water. The test utilized to measure wicking determines the effects of capillary action of a fluid on a fabric which is suspended vertically and partially immersed in the fluid.

Wicking is determined by clamping a web portion in a water bath so that the water bath contacts the specimen. Tests are conducted at a standard laboratory atmosphere of 23±2° C. (73.4±3.6° F.) and 50±5% relative humidity. Specimens of fabric are cut to 1 by 8±0.1 in. (25.4 by 203.2±2.5 mm) in both directions of the material machine direction (MD) and cross direction (CD). The test specimens are obtained from areas of the sample that are free of folds, wrinkles, or any distortions.

The wicking is based upon the amount of water absorbed in the vertical given direction by the specimen within a specified time period. The reservoir is filled with test fluid (deionized water) and the test specimen is clamped into the specimen holder which is then positioned so the lower edge of the strip will extend approximately 1 in. (25.4 mm) into the fluid. When the free end of the specimen is placed in the test fluid, the stop watch is started and the fluid is observed as it migrates up the specimen. At 15, 30, 45, and 60 seconds, the height is recorded in centimeters of the lowest point of the leading edge of the migrating fluid.

TABLE 1

| Example No. (Units) | Bone Dry Basis Weight (lb/ream) | Dry Caliper (inches) | Wet Caliper (inches) | Dry Caliper/ Dry Uncompress Caliper (%) | Wet Caliper/ Dry Uncompress Caliper (%) | Drape CD (cm) | Drape MD (cm) |
|---|---|---|---|---|---|---|---|
| Example 1 | 16.68 | 0.0075 | 0.0114 | 100% | 151% | 3.44 | 4.71 |
| Example 2 | 15.67 | 0.0058 | 0.0103 | 77% | 138% | 2.96 | 3.98 |
| Example 3 | 15.80 | 0.0045 | 0.0097 | 60% | 130% | 3.01 | 4.16 |
| Example 4 | 23.01 | 0.0122 | 0.0119 | 100% | 98% | 3.77 | 4.17 |
| Example 5 | 23.56 | 0.0094 | 0.0120 | 77% | 98% | 3.63 | 3.84 |
| Example 6 | 23.20 | 0.0077 | 0.0117 | 63% | 96% | 3.33 | 4.03 |

TABLE 2

| Example No. (Units) | Elmendorf Tear CD (gm) | Elmendorf Tear MD (gm) | Mullen Burst (psi) | Oil Absorbent Capacity (grams) | Water Absorbent Capacity (grams) | Water Absorbency Rate (seconds) |
|---|---|---|---|---|---|---|
| Example 1 | 27.44 | 21.18 | 8.33 | 1.12 | 1.43 | 5.77 |
| Example 2 | 24.11 | 26.26 | 7.29 | 1.02 | 1.41 | 6.90 |
| Example 3 | 23.00 | 18.29 | 7.04 | 0.87 | 1.33 | 7.79 |
| Example 4 | 35.69 | 26.24 | 9.50 | 1.51 | 2.06 | 2.79 |
| Example 5 | 41.25 | 29.13 | 10.00 | 1.37 | 1.98 | 2.91 |
| Example 6 | 38.24 | 31.44 | 10.00 | 1.32 | 2.00 | 2.86 |

TABLE 3

| Example No. (Units) | Water Wicking 15 sec MD (cm) | MD Peak Load (gm) | MD Peak Strain (%) | MD Peak Energy (kg-mm) | MD Peak TEA (gm-mm/sq.mm) |
|---|---|---|---|---|---|
| Example 1 | 2.62 | 4840.86 | 6.67 | 19.38 | 2.50 |
| Example 2 | 2.31 | 4517.16 | 4.74 | 12.97 | 1.68 |
| Example 3 | 2.48 | 4437.35 | 4.62 | 12.50 | 1.61 |
| Example 4 | 3.20 | 5758.70 | 6.59 | 21.30 | 2.75 |
| Example 5 | 3.17 | 5877.75 | 7.44 | 21.95 | 2.84 |
| Example 6 | 3.07 | 5364.20 | 4.83 | 13.93 | 1.80 |

TABLE 4

| Example No. (Units) | Dry CD Peak Load (gm) | Dry CD Peak Strain (%) | Dry CD Peak Energy (kg-mm) | Dry CD Peak TEA (gm-mm/sq.mm) | Wet MD Peak Load (gm) | Wet MD Peak Strain (%) | Wet MD Peak Energy (kg-mm) | Wet MD Peak TEA (gm-mm/sq.mm) |
|---|---|---|---|---|---|---|---|---|
| Example 1 | 2912.28 | 7.20 | 12.16 | 1.57 | 1672.47 | 4.71 | 3.09 | 0.40 |
| Example 2 | 2708.11 | 6.53 | 10.25 | 1.32 | 1508.52 | 4.68 | 2.78 | 0.36 |
| Example 3 | 2614.24 | 6.46 | 10.27 | 1.33 | 1536.42 | 3.76 | 2.21 | 0.28 |
| Example 4 | 3260.30 | 4.26 | 8.35 | 1.08 | 2073.96 | 6.34 | 4.74 | 0.612 |
| Example 5 | 2873.46 | 6.21 | 9.36 | 1.21 | 2085.46 | 6.15 | 4.54 | 0.59 |
| Example 6 | 2978.61 | 6.57 | 10.51 | 1.36 | 1962.78 | 4.75 | 3.49 | 0.45 |

TABLE 5

| Example No. (Units) | Wet CD Peak Load (gm) | Wet CD Peak Strain (%) | Wet CD Peak Energy (kg-mm) | Wet CD Peak TEA (gm-mm/sq.mm) |
|---|---|---|---|---|
| Example 1 | 1037.19 | 5.34 | 2.46 | 0.32 |
| Example 2 | 897.20 | 5.46 | 2.29 | 0.30 |
| Example 3 | 931.81 | 4.68 | 1.96 | 0.25 |
| Example 4 | 1152.70 | 5.64 | 2.82 | 0.36 |
| Example 5 | 952.80 | 5.16 | 2.31 | 0.30 |
| Example 6 | 978.62 | 5.56 | 2.57 | 0.33 |

EXAMPLES 7–11

In these Examples, a paper web produced according to the uncreped through-air drying technology having a basis weight of approximately 16 lbs/ream 2880 square feet was subjected to calendering to reduce its uncompressed caliper by 37%. The web was subjected to various nip pressures per linear inch. The produced webs were then wetted to determine their extent of recovery back to their uncompressed states.

The webs were formed from a furnish of 61% Owensboro recycled fiber and 31% Mobile Pine with about 20 lbs/ton of Kymene wet strength resin. The uncompressed web caliper was approximately 0.008". Compression calipers were determined as an average of caliper measurements taken at three different locations on the web. At a pressure of 63 PLI, the dry web was compressed to approximately 0.0048"; and at a pressure of 96 PLI, the dry web was compressed to approximately 0.0042. In each instance, upon saturating the web with water, the caliper returned to approximately 0.0084" after 7 seconds and then settled to approximately 0.0070" after 2 minutes.

EXAMPLES 12–16

In these Examples, a paper web produced according to the uncreped through-air drying technology having a basis weight of approximately 16 lbs/ream 2880 square feet was subjected to calendering described below to reduce its uncompressed caliper. The web was subjected to various nip pressures per linear inch. The produced webs were then wetted to determine their extent of recovery back to their uncompressed states.

The webs were formed from a furnish of 61% Owensboro recycled fiber and 31% Mobile Pine and 20 lbs/ton Kymene wet strength resin. The web had a stretch of approximately 10% with a rush transfer of approximately 15%. The uncompressed web caliper was approximately 0.0081". At a pressure of 13 PLI, the dry web was compressed to approximately 0.0065"; at a PLI of 46, the dry web was compressed to approximately 0.0055"; at a pressure of 63 PLI, the dry web was compressed to approximately 0.0048". The 13 PLI web returned to approximately 0.0089", the 46 PLI web returned to approximately 0.0085", and the 63 PLI web returned to approximately 0.0083" upon wetting after 7 seconds. The 13 PLI and 46 PLI webs settled to approximately 0.0070" and 0.0071", respectively, after 2 minutes.

EXAMPLE 17

Another uncreped through-air drying-formed product (made from 33% Owensboro recycled fiber, 13% Fox River recycled fiber and 52% Mobile Pine with 20 lbs/ton Kymene wet strength resin and having a rush transfer of approximately 25%) was subjected to the evaluations described above. The original uncompressed caliper of this web was approximately 0.022". The web was compressed down to 0.011". After being wet for a period of 7 seconds, the web expanded back to approximately 0.0144".

EXAMPLES 18–21

In Examples 18–21, a web made according to the uncreped through-air drying process was compared in an uncompressed state (Example 18); in a compressed state of 86% the original caliper (Example 19); in a compressed state of 84% the original caliper (Example 20); and in a compressed state of 71% the original caliper (Example 21).

The webs of Examples 18–21 are made from a furnish similar to that utilized in Examples 1–3 and contain 55% Owensboro recycled fibers, 28% Mobile pine, 7% Fox River recycled fibers and 10% broke. The webs have a basis weight of approximately 16 lb/ream.

EXAMPLES 22–25

In Examples 22–25, a web made according to the heavy wet crepe process was compared in an uncompressed state (Example 22); in a compressed state of 79% the original caliper (Example 23); in a compressed state of 74% the original caliper (Example 24); and in a compressed state of 63% the original caliper (Example 25).

The webs of Examples 22–25 are made from a furnish containing 45% Mobile pine, 15% hardwoods, 30% broke, and 10% chemithermomechanical pulp. The webs have a basis weight of between 18 and 19 lb/ream.

EXAMPLES 26–29

In Examples 26–29, a web made according to the uncreped through-air drying process was compared in an uncompressed state (Example 26); in a compressed state of 85% the original caliper (Example 27); in a compressed state of 68% the original caliper (Example 28); and in a compressed state of 55% the original caliper (Example 29).

The webs of Examples 26–29 are made from a furnish containing 80% sulfite softwood pulp (pulp processed chemically with a mixture of sulfurous acid and bisulfite ion), 10% chemithermomechanical softwood pulp, and 10% broke. The webs have a basis weight of between 17 and 19 lb/ream.

The following tables set forth various measurements that were made on the webs formed from Examples 18–29.

TABLE 6

| Example No. (Units) | Bone Dry Basis Weight (lb/2880) | Dry Caliper (inches) | Wet Caliper (inches) | Compression Ratio | Wet Caliper/ Uncompress Dry Caliper (%) | Drape CD (cm) | Drape MD (cm) | Elmendorf Tear CD (gm) |
|---|---|---|---|---|---|---|---|---|
| Example 18 | 16.1 | .0075 | 0.0111 | 0 | 147% | 3.72 | 4.85 | 25.28 |
| Example 19 | 16.3 | 0.0065 | 0.0108 | .14 | 143% | 3.25 | 4.43 | 26.30 |
| Example 20 | 15.4 | 0.0063 | 0.0104 | .16 | 138% | 3.07 | 4.08 | 23.26 |
| Example 21 | 15.7 | 0.0053 | 0.0096 | .29 | 128% | 2.52 | 3.55 | 21.85 |
| Example 22 | 19.1 | 0.0063 | 0.0077 | 0 | 121% | 3.07 | 3.93 | 38.09 |
| Example 23 | 19.3 | 0.0050 | 0.0069 | .21 | 109% | 3.02 | 4.03 | 41.28 |
| Example 24 | 19.6 | 0.0047 | 0.0068 | .26 | 108% | 3.13 | 3.95 | 43.75 |
| Example 25 | 18.9 | 0.004 | 0.0067 | .37 | 105% | 2.80 | 3.22 | 36.62 |
| Example 26 | 18.7 | 0.0059 | 0.0071 | 0 | 120% | 3.07 | 3.82 | 34.45 |
| Example 27 | 17.5 | 0.0050 | 0.0066 | .15 | 113% | 2.78 | 3.07 | 25.37 |
| Example 28 | 18.4 | 0.0040 | 0.0063 | .32 | 107% | 2.78 | 3.65 | 27.62 |
| Example 29 | 17.8 | 0.0032 | 0.0068 | .45 | 115% | 2.45 | 3.40 | 25.40 |

TABLE 7

| Example No. (Units) | Elmendorf Tear MD (gm) | Mullen Burst (psi) | Oil Absorbent Capacity (grams) | Water Capacity Abs. Capacity (grams) | Water Absorbency Rate (seconds) |
|---|---|---|---|---|---|
| Example 18 | 26.60 | 8.83 | 1.11 | 1.42 | 6.66 |
| Example 19 | 25.37 | 8.17 | 1.11 | 1.42 | 8.08 |
| Example 20 | 26.27 | 6.83 | 1.09 | 1.41 | 6.39 |
| Example 21 | 24.67 | 8.50 | 1.01 | 1.40 | 8.96 |
| Example 22 | 28.89 | 9.67 | 1.02 | 1.21 | 56.91 |
| Example 23 | 32.92 | 8.83 | 0.91 | 1.12 | 67.66 |
| Example 24 | 33.07 | 10.17 | 0.86 | 1.19 | 66.14 |
| Example 25 | 28.86 | 8.83 | 0.76 | 1.20 | 39.37 |
| Example 26 | 20.46 | 8.83 | 0.98 | 1.07 | 43.07 |
| Example 27 | 21.18 | 9.17 | 0.95 | 1.00 | 43.48 |
| Example 28 | 22.60 | 7.67 | 0.82 | 1.04 | 47.19 |
| Example 29 | 16.52 | 8.00 | 0.73 | 0.91 | 61.27 |

TABLE 8

| Summary (Units) | Water Wicking 15 sec CD (cm) | Water Wicking 30 sec CD (cm) | Water Wicking 45 sec CD (cm) | Water Wicking 60 sec CD (cm) | Water Wicking 15 sec MD (cm) | Water Wicking 30 sec MD (cm) | Water Wicking 45 sec MD (cm) | Water Wicking 60 sec MD (cm) |
|---|---|---|---|---|---|---|---|---|
| Example 18 | 1.7 | 2.4 | 3.0 | 3.4 | 2.4 | 3.2 | 3.9 | 4.5 |
| Example 19 | 1.5 | 2.2 | 2.9 | 3.4 | 2.4 | 3.3 | 4.0 | 4.5 |
| Example 20 | 1.6 | 2.5 | 3.2 | 3.6 | 2.4 | 3.4 | 4.2 | 4.6 |
| Example 21 | 1.6 | 2.5 | 2.9 | 3.4 | 2.2 | 3.1 | 3.8 | 4.6 |
| Example 22 | 0.6 | 0.9 | 1.3 | 1.6 | 1.0 | 1.4 | 1.9 | 2.3 |
| Example 23 | 0.6 | 1.1 | 1.3 | 1.5 | 0.9 | 1.3 | 1.8 | 2.1 |
| Example 24 | 0.6 | 1.0 | 1.3 | 1.7 | 0.7 | 1.2 | 1.5 | 2.2 |
| Example 25 | 0.9 | 1.5 | 1.8 | 2.3 | 1.1 | 1.8 | 2.3 | 2.5 |
| Example 26 | 1.0 | 1.5 | 2.1 | 2.4 | 1.0 | 1.5 | 1.8 | 2.2 |
| Example 27 | 1.0 | 1.5 | 2.0 | 2.4 | 1.0 | 1.4 | 1.8 | 2.1 |
| Example 28 | 1.0 | 1.4 | 1.8 | 2.2 | 1.0 | 1.4 | 1.6 | 2.0 |
| Example 29 | 0.9 | 1.3 | 1.6 | 2.0 | 0.9 | 1.3 | 1.6 | 2 |

TABLE 9

| Summary (Units) | Dry MD Peak Load (gm) | Dry MD Peak Strain (%) | Dry MD Peak Energy (kg-mm) | Dry MD Peak TEA (gm-mm/sq. mm.) | Dry CD Peak Load (gm) | Dry CD Peak Strain (%) | Dry CD Peak Energy (kg-mm) | Dry CD Peak TEA (gm-mm/sq. Mm.) |
|---|---|---|---|---|---|---|---|---|
| Example 18 | 4657.70 | 6.49 | 19.22 | 2.48 | 2958.98 | 6.70 | 11.64 | 1.50 |
| Example 19 | 5070.30 | 5.79 | 18.46 | 2.38 | 2955.31 | 6.63 | 11.59 | 1.50 |
| Example 20 | 4407.28 | 4.73 | 13.13 | 1.70 | 2512.51 | 6.31 | 9.30 | 1.20 |
| Example 21 | 4495.35 | 4.74 | 13.32 | 1.72 | 2676.42 | 6.49 | 10.42 | 1.35 |
| Example 22 | 6762.79 | 7.89 | 36.10 | 4.66 | 2826.38 | 4.55 | 7.62 | 0.98 |
| Example 23 | 7005.42 | 7.86 | 36.06 | 4.66 | 2969.14 | 4.59 | 8.37 | 1.08 |
| Example 24 | 7450.11 | 9.08 | 44.03 | 5.69 | 3118.29 | 4.77 | 9.14 | 1.18 |
| Example 25 | 5828.80 | 6.20 | 22.37 | 2.89 | 2525.12 | 4.05 | 6.24 | 0.81 |
| Example 26 | 4470.33 | 7.26 | 22.33 | 2.89 | 2179.85 | 5.05 | 6.39 | .083 |
| Example 27 | 3808.23 | 6.35 | 16.57 | 2.14 | 2565.81 | 5.36 | 8.10 | 1.05 |
| Example 28 | 4139.16 | 5.68 | 15.77 | 2.04 | 2293.31 | 4.52 | 5.89 | 0.76 |
| Example 29 | 4459.36 | 6.15 | 18.45 | 2.38 | 1730.49 | 4.23 | 4.49 | 0.58 |

TABLE 10

| Summary (Units) | Wet MD Peak Load (gm) | Wet MD Peak Strain (%) | Wet MD Peak Energy (kg-mm) | Wet MD Peak TEA (gm-mm/sq. mm.) | Wet CD Peak Load (gm) | Wet CD Peak Strain (%) | Wet CD Peak Energy (kg-mm) | Wet CD Peak TEA (gm-mm/sq. mm.) |
|---|---|---|---|---|---|---|---|---|
| Example 18 | 1683.16 | 5.78 | 3.64 | 0.47 | 925.98 | 6.06 | 2.76 | 0.3565 |
| Example 19 | 1708.85 | 5.73 | 3.63 | 0.47 | 978.21 | 4.58 | 2.21 | 0.286 |
| Example 20 | 1352.56 | 4.85 | 2.73 | 0.35 | 757.07 | 5.86 | 2.22 | 0.2864 |
| Example 21 | 1428.73 | 4.52 | 2.62 | 0.34 | 841.78 | 5.96 | 2.56 | 0.3305 |
| Example 22 | 2050.55 | 4.30 | 3.11 | 0.40 | 832.29 | 3.85 | 1.47 | 0.1897 |
| Example 23 | 1625.09 | 4.07 | 2.79 | 0.36 | 836.68 | 3.65 | 1.50 | 0.1931 |
| Example 24 | 2279.30 | 4.27 | 4.05 | 0.52 | 948.03 | 3.43 | 1.50 | 0.1932 |
| Example 25 | 1825.33 | 4.13 | 2.86 | 0.37 | 697.15 | 3.38 | 1.13 | 0.1463 |
| Example 26 | 1567.75 | 7.12 | 4.99 | 0.65 | 623.56 | 4.80 | 1.38 | 0.1788 |
| Example 27 | 1253.91 | 5.79 | 3.31 | 0.43 | 775.19 | 4.74 | 1.51 | 0.1945 |
| Example 28 | 1292.02 | 6.37 | 3.69 | 0.48 | 745.45 | 4.43 | 1.55 | 0.2007 |
| Example 29 | 1638.72 | 6.66 | 4.37 | 0.56 | 550.31 | 4.12 | 1.15 | 0.1486 |

EXAMPLES 30–35

In Examples 30–32, webs (with basis weights of approximately 16 lbs/ream) made from the furnish utilized in Examples 18–21 having 55% Owensboro recycled fibers, 28% Mobile pine, 7% Fox River recycled fibers and 10% broke were subjected to various calendering or compression steps after normal calendering to determine the amount of bounce back in the dry state. Four samples of each web were compressed at various calender loads and their calipers were determined immediately after being compressed and after 10 minutes, 50 minutes, and 100 minutes. The uncompressed caliper column represents calipers for the webs prior to being subjected to these additional compression steps. In other words, the uncompressed caliper column shows values for webs that have only been subjected to normal calendering typical in a papermaking process but which have not been subjected to the additional compression calendering forces. An average for each particular web is also shown in the table.

For a comparison, webs made according to a uncreped through-air drying process and employing 70% recycled fiber, 15% Mobile pine, and 15% BCTMP were also subjected to similar tests. The results are shown in Table 12. The pressures applied to compress the webs may be computed by adding multiplying 3.35 times the stated psig and then adding 12.5 to that value.

The results demonstrate that webs made from pulps without BCTMP fibers demonstrate a certain degree of recovery or bounce back over time as do the webs made from pulps having BCTMP fibers.

TABLE 11

| Example No. (Units) | Calender (psi-g) | Uncompressed Caliper | Caliper after Compressing | Caliper after 10 min. | Caliper after 50 min. | Caliper after 100 min. |
|---|---|---|---|---|---|---|
| Example 30 | 0 | 0.0072 | 0.0053 | 0.0056 | 0.0057 | 0.0059 |
| | 0 | 0.008 | 0.006 | 0.0061 | 0.0062 | 0.0063 |
| | 0 | 0.0079 | 0.0064 | 0.0068 | 0.0068 | 0.0069 |
| | 0 | 0.0078 | 0.0065 | 0.0066 | 0.0067 | 0.0068 |
| | avg. | 0.007725 | 0.00605 | 0.006275 | 0.00635 | 0.006475 |
| Example 31 | 4 | 0.0074 | 0.0057 | 0.0063 | 0.0063 | 0.0063 |
| | 4 | 0.0079 | 0.0059 | 0.0061 | 0.0062 | 0.0063 |
| | 4 | 0.0078 | 0.0052 | 0.0057 | 0.0058 | 0.0059 |
| | 4 | 0.0075 | 0.0054 | 0.0051 | 0.0057 | 0.0058 |
| | avg. | 0.00765 | 0.00555 | 0.0058 | 0.0006 | 0.006075 |
| Example 32 | 10 | 0.0069 | 0.0045 | 0.0048 | 0.0048 | 0.0049 |
| | 10 | 0.007 | 0.0046 | 0.0048 | 0.0048 | 0.0048 |
| | 10 | 0.0071 | 0.0046 | 0.0048 | 0.0049 | 0.0049 |
| | 10 | 0.007 | 0.0048 | 0.0049 | 0.005 | 0.005 |
| | avg. | 0.007 | 0.004625 | 0.004825 | 0.004875 | 0.0049 |

TABLE 12

| Example No. (Units) | Calender (psi-g) | Uncompressed Caliper | Caliper after Compressing | Caliper after 10 min. | Caliper after 50 min. | Caliper after 100 min. |
|---|---|---|---|---|---|---|
| Example 33 | 0 | 0.014 | 0.0108 | 0.0111 | 0.0117 | 0.0118 |
| | 0 | 0.014 | 0.0115 | 0.012 | 0.0121 | 0.0121 |
| | 0 | 0.0141 | 0.011 | 0.0112 | 0.0115 | 0.0117 |
| | 0 | 0.0139 | 0.0108 | 0.0109 | 0.011 | 0.0111 |
| | avg. | 0.014 | 0.011025 | 0.0113 | 0.011575 | 0.011675 |
| Example 34 | 4 | 0.0141 | 0.0089 | 0.0092 | 0.0098 | 0.0099 |
| | 4 | 0.014 | 0.0092 | 0.0098 | 0.0101 | 0.0102 |
| | 4 | 0.0142 | 0.0092 | 0.0096 | 0.0099 | 0.01 |
| | 4 | 0.0141 | 0.0091 | 0.0097 | 0.0099 | 0.01 |
| | avg. | 0.0141 | 0.0091 | 0.009575 | 0.009925 | 0.010025 |
| Example 35 | 8 | 0.0141 | 0.0079 | 0.0081 | 0.0082 | 0.0083 |
| | 8 | 0.0139 | 0.0079 | 0.0081 | 0.0083 | 0.0083 |
| | 8 | 0.014 | 0.0081 | 0.0083 | 0.0087 | 0.0088 |
| | 8 | 0.0139 | 0.0077 | 0.0079 | 0.008 | 0.008 |
| | avg. | 0.013975 | 0.0079 | 0.0081 | 0.0083 | 0.00835 |

EXAMPLES 36–39

In the following examples, the calipers of a web with a basis weight of approximately 20 lb/ream formed from 100% Ponderosa recycled fibers with Kymene wet strength agent at a 0.6% by fiber weight add-on were measured in cured and uncured states (i.e., after the sheets were completely dried and after the sheets were only semi-dried). The Kymene wet strength agent remains slightly uncured after only 3 minutes at 250° F. The sheets were subjected to certain levels of compression as indicated in Tables 13 and 14. The results shown for Example 36 in Table 13 are for a web that is heated in an oven for 3 minutes at 250° F. The results shown for Examples 37–39 Table 14 are for webs that are heated for 20 minutes at 250° F.

As shown in the tables, sheets that are not completely cured prior to compression show less bounce back after wetting than sheets that are completely cured.

TABLE 13

| Example Number | Dry Caliper (unpressed) | Dry Caliper compressed | Wet Caliper compressed |
|---|---|---|---|
| Example 36 | 0.0075 | 0.0044 | 0.0054 |

TABLE 14

| Example Number | Dry Caliper (unpressed) | Dry Caliper compressed | Wet Caliper compressed |
|---|---|---|---|
| Example 37 | 0.0074 | 0.0041 | 0.0064 |
| Example 38 | 0.0075 | 0.0047 | 0.0067 |
| Example 39 | 0.0079 | 0.0041 | 0.0067 |

EXAMPLES 40–47

In Examples 40–47, the furnish and the conditions utilized in Examples 36–39 were employed. Examples 4043 in Table 15 show results for a web that is heated in an oven for 3 minutes at 250° F. and then subjected to various compressions. Example 40 is an uncompressed web. Examples 44–47 in Table 15 show results for a web that is heated for 20 minutes at 250° F. and then subjected to various compressions. Example 44 is an uncompressed web. As indicated in the results, the water absorbent capacity for the cured samples was not substantially reduced despite being highly compressed.

TABLE 15

| Example Number | Caliper (inches) | Water Absorbent Capacity (grams) |
|---|---|---|
| Example 40 | 0.00717 | 1.56 |
| Example 41 | 0.00663 | 1.41 |
| Example 42 | 0.00660 | 1.14 |
| Example 43 | 0.00513 | 1.09 |
| Example 44 | 0.00790 | 1.40 |
| Example 45 | 0.00590 | 1.51 |
| Example 46 | 0.00513 | 1.51 |
| Example 47 | 0.00407 | 1.34 |

Although the present sheets have been compressed according to the present invention to have their dry calipers reduced, the sheets exhibit a wet caliper that bounces back when saturated with water. In addition, despite being compressed, the water absorbent capacities of the compressed sheets have not been substantially reduced, contrary to the conventional wisdom in the art.

Although preferred embodiments of the invention have been described using specific terms, devices, and methods, such description is for illustrative purposes only. The words used are words of description rather than of limitation. It is to be understood that changes and variations may be made by those of ordinary skill in the art without departing from the spirit or the scope of the present invention, which is set forth in the following claims. In addition, it should be understood that aspects of the various embodiments may be interchanged both in whole or in part. Therefore, the spirit and scope of the appended claims should not be limited to the description of the preferred versions contained therein.

What is claimed is:

1. A method for making an absorbent structure comprising:

a) forming a wet sheet from a slurry of fibers containing a permanent wet strength resin without compacting the wet sheet during the forming of said wet sheet;

b) drying said wet sheet with a through-dryer so as to form an uncompressed paper-based web that is uncreped, and to cure said permanent wet strength resin; and c) compressing said uncompressed structure to a thickness of from about 50% to about 90% of the original thickness of said uncompressed structure to form a compressed structure that recovers at least about 70% of its original thickness when said compressed structure is saturated with a liquid.

2. The method of claim 1 wherein said absorbent structure comprises fibers selected from the group consisting of fibers composed of natural wood pulps, synthetic resins, flax, milkweed, abaca, hemp, and cotton.

3. The method of claim 2 wherein said wood pulps comprise pulps selected from the group consisting of recycled fiber pulp and non-recycled fiber pulp.

4. The method of claim 1 wherein said uncompressed structure is compressed to a thickness of from about 60% to about 90% of the original thickness of said uncompressed structure.

5. The method of claim 1 wherein said uncompressed structure is compressed to a thickness of from about 70% to about 90% of the original thickness of said uncompressed structure.

6. The method of claim 1 wherein said uncompressed structure is compressed to a thickness of from about 75% to about 90% of the original thickness of said uncompressed structure.

7. The method of claim 1 wherein said uncompressed structure is compressed to a thickness of from about 80% to about 90% of the original thickness of said uncompressed structure.

8. The method of claim 1, wherein the step of compressing said uncompressed structure comprises steam calendering.

9. A process for forming an absorbent compressed paper-based web, said process comprising the steps of:

a) forming a paper-containing slurry;

b) adding a permanent wet strength resin to said slurry;

c) transferring said slurry to a paper-forming wire;

d) drying said slurry with a through-dryer so as to form an uncompressed paper-based web that is uncreped, and to cure said permanent wet strength resin; and e) compressing said paper-based web by applying pressure to said web to form a compressed paper-based web, said pressure being sufficient to reduce the thickness of said uncompressed paper-based web to a caliper that is from 50% to about 90% of the original caliper of said uncompressed paper-based web, said compressed paper web recovering at least about 70% of its original thickness when said compressed web is saturated with a liquid.

10. The method of claim 7, wherein the step of compressing said paper-based web comprises steam calendering.

11. A process for forming an absorbent compressed paper-based web, said process comprising the steps of:

a) forming an original paper-based web containing a permanent wet strength resin;

b) drying said paper-based web with a through-dryer so as to form an uncompressed paper-based web that is uncreped, and to cure said permanent wet strength resin; and c) compressing said paper-based web by applying pressure to said web to form a compressed paper-based web, said pressure being sufficient to reduce the thickness of said original paper-based web to a caliper that is from 50% to about 90% of the original caliper of said original paper-based web, said compressed paper-based web recovering at least about 70% of its original thickness when said compressed paper-based web is saturated with a liquid.

12. The method of claim 11, wherein the step of compressing said paper-based web comprises steam calendering.

* * * * *